US006238838B1

(12) United States Patent
Gaschler et al.

(10) Patent No.: US 6,238,838 B1
(45) Date of Patent: May 29, 2001

(54) RADIATION-SENSITIVE MIXTURE COMPRISING IR-ABSORBING, ANIONIC CYANINE DYES AND RECORDING MATERIAL PREPARED THEREWITH

(75) Inventors: Otfried Gaschler, Wiesbaden; Andreas Elsaesser, Idstein; Fritz-Feo Grabley, Kelkheim; Joerg Jung, Floersheim; Engelbert Pliefke; Hans-Joachim Schlosser, both of Wiesbaden, all of (DE)

(73) Assignee: Afga Gevaert, Mortsel (BE)

( * ) Notice: Subject to any disclaimer, the term of this patent is extended or adjusted under 35 U.S.C. 154(b) by 0 days.

(21) Appl. No.: 09/362,861

(22) Filed: Jul. 29, 1999

(30) Foreign Application Priority Data

Aug. 1, 1998 (DE) ..... 198 34 745

(51) Int. Cl.[7] ..... G03C 1/77

(52) U.S. Cl. ..... 430/278.1; 430/270.1; 430/302

(58) Field of Search ..... 430/270.1, 278.1, 430/302

(56) References Cited

U.S. PATENT DOCUMENTS

| | | | | |
|---|---|---|---|---|
| 4,708,925 | * | 11/1987 | Newman | 430/270 |
| 4,871,656 | * | 10/1989 | Parton et al. | 430/522 |
| 5,260,178 | * | 11/1993 | Harada et al. | 430/508 |
| 5,339,737 | * | 8/1994 | Lewis et al. | 101/454 |
| 5,340,699 | * | 8/1994 | Haley et al. | 430/302 |
| 5,747,233 | * | 5/1998 | Lonsky et al. | 430/522 |
| 5,814,431 | * | 9/1998 | Nagasaka et al. | 430/281.1 |
| 5,858,604 | * | 1/1999 | Takeda et al. | 430/162 |
| 5,948,596 | * | 9/1999 | Zhong et al. | 430/278.1 |
| 6,004,728 | * | 12/1999 | Deroover et al. | 430/302 |
| 6,040,113 | * | 3/2000 | Van Damme et al. | 430/271.1 |
| 6,051,361 | * | 4/2000 | Hattori et al. | 430/270.1 |

FOREIGN PATENT DOCUMENTS

| | | | |
|---|---|---|---|
| 1 447 963 | | 11/1968 | (DE) . |
| 97 39 302 | | 3/1999 | (DE) . |
| 288 076 | * | 10/1988 | (EP) . |
| 0 290 916 | | 11/1988 | (EP) . |
| 0 556 690 | | 8/1993 | (EP) . |
| 0 784 233 | | 7/1997 | (EP) . |
| 0 823 327 | | 2/1998 | (EP) . |
| 908 307 A2 | * | 4/1999 | (EP) . |
| 1154759 | | 6/1969 | (GB) . |
| 96/20429 | | 7/1996 | (WO) . |
| 97/39894 | | 10/1997 | (WO) . |

* cited by examiner

*Primary Examiner*—Hoa Van Le
*Assistant Examiner*—Barbara Gilmore
(74) *Attorney, Agent, or Firm*—Foley & Lardner

(57) ABSTRACT

A positive-working, radiation-sensitive mixture which contains an organic, polymeric binder which is insoluble in water but soluble or at least swellable in aqueous alkaline solution and at least one IR-absorbing dye, (I)

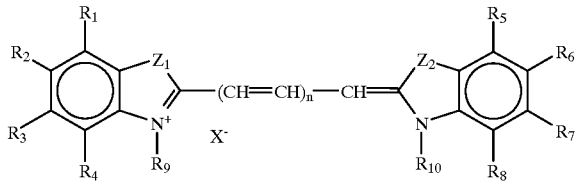

is described. A daylight-insensitive recording material which can be provided with an image using IR radiation and has a substrate and a layer comprising the mixture is also disclosed. After imagewise exposure, in particular to IR laser beams, and development with an aqueous alkaline solution, an offset printing plate can be formed therefrom.

18 Claims, No Drawings

RADIATION-SENSITIVE MIXTURE COMPRISING IR-ABSORBING, ANIONIC CYANINE DYES AND RECORDING MATERIAL PREPARED THEREWITH

BACKGROUND OF THE INVENTION

1. Field of the Invention

The present invention relates to a positive-working, radiation-sensitive mixture which contains an organic polymeric binder which is insoluble in water but soluble in aqueous alkaline solution and an IR-absorbing dye or pigment. It also relates to a recording material comprising a substrate and a layer of this mixture and a process for the production of lithographic printing plates from the recording material. The layer has high sensitivity in the IR range so that the recording material is suitable for direct thermal image production by the computer-to-plate CTP method.

2. Description of the Related Art

The use of dyes and pigments as IR absorbers in radiation-sensitive mixtures is generally known in the art. For example, the recording material according to WO 96/20429 comprises a layer with IR-absorbing carbon black pigments, 1,2-naphthoquinone-2-diazidosulfonic esters or -carboxylic esters and a phenol resin. The 1,2-naphthoquinone-2-diazidosulfonic acid or -carboxylic acid can also be directly esterified with the hydroxyl groups of the phenol resin. The layer is first exposed uniformly to UV radiation and then imagewise to IR laser beams. As a result of the action of the IR radiation, specific parts of the layer rendered soluble by the UV radiation become insoluble again. This is therefore a negative-working system. The processing of the material is thus relatively complicated.

EP-A 0 784 233 likewise describes a negative-working mixture which contains a) novolak and/or polyvinylphenol, b) amino compounds for curing the component a), c) a cyanine and/or polymethine dye which absorbs in the near IR range and d) photochemical acid formers.

The non-prior published Patent Application DE 197 39 302 describes a positive-working, IR-sensitive mixture which comprises a binder which is insoluble in water but soluble, at least swellable in aqueous alkali and carbon black particles dispersed in said binder. The carbon black particles are the radiation-sensitive component essential for image-wise differentiation.

WO 97/39894 describes layers which contain dissolution-inhibiting additives. The additives reduce the solubility of the layer in the unexposed parts in aqueous alkaline developers. These additives are, in particular, cationic compounds, especially dyes and cationic IR absorbers, such as quinolinecyanine dyes, benzothiazolecyanine dyes or merocyanines, in addition to various pigments. However, if these layers are heated to 50 to 100° C. for from 5 to 20 s, the additives lose their inhibiting effect, and the layer becomes soluble in aqueous alkaline solutions.

The positive-working mixture disclosed in EP-A 0 823 327 contains cyanine, polymethine, squarylium, croconium, pyrylium or thiopyrylium dyes as IR absorbers. Most of these dyes are cationic and have an inhibiting effect. In addition, many of them are halogen-containing. Under unfavorable conditions, environmentally harmful decomposition products may form therefrom. However, some dyes having a betaine structure and an anionic dye (compound S-9 on page 7) are also disclosed. After drying of the layer, however, this anionic dye, owing to its large number of sulfonate groups, generally causes crystallization or precipitation of components of the layer, which leads to substantially poorer properties of the IR-sensitive layer and also results in a poor appearance of the layer.

The disadvantage of the layer compositions generally known in the art is that the increase in solubility which is achieved by the post-bake is reversible after storage at room temperature. Thus, if a printing plate is not further processed immediately after baking (e.g. using a heating oven), the development properties change. Thus, reproduction problems during the processing of the recording materials may also result. In addition, many cationic additives are halogen-containing, so that environmentally harmful decomposition products may form under unfavorable conditions.

SUMMARY OF THE INVENTION

It is one object of the invention to provide a radiation-sensitive mixture and a recording material comprising the same.

These and other objects can be achieved by a positive-working, radiation-sensitive mixture comprising: an organic, polymeric binder which is insoluble in water but soluble or at least swellable in aqueous alkaline solution and at least one IR-absorbing dye, wherein the IR-absorbing dye is an anionic cyanine dye of the formula I (I)

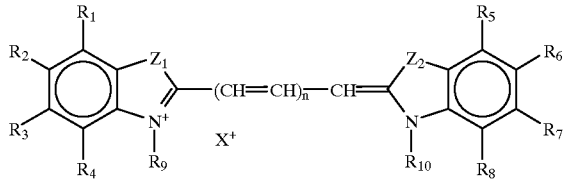

wherein n is 2 or 3, $R^1$ to $R^8$ independently of one another, are a hydrogen or halogen atom, a sulfonate, carboxylate, phosphonate, hydroxyl, $(C_1-C_4)$alkoxy, nitro, amino, $(C_1-C_4)$alkylamino or di$(C_1-C_4)$alkylamino group or a $(C_6-C_{10})$aryl group which in turn may be substituted by one or more halogen atoms and/or one or more sulfonate, carboxylate, phosphonate, hydroxyl, $(C_1-C_4)$alkoxy, nitro, amino, $(C_1-C_4)$alkylamino and/or di$(C_1-C_4)$alkylamino groups, $R^9$ and $R^{10}$ independently of one another, are a straight-chain or branched $(C_1-C_6)$alkyl, a $(C_7-C_{16})$aralkyl or a $(C_6-C_{10})$aryl group, each of which in turn may be substituted by one or more halogen atoms and/or one or more sulfonate, carboxylate, phosphonate, hydroxyl, $(C_1-C_4)$alkoxy, nitro, amino, $(C_1-C_4)$alkylamino and/or di$(C_1-C_4)$alkylamino groups, $Z^1$ and $Z^2$ independently of one another, are a sulfur atom, a di$(C_1-C_4)$-alkylmethylene group or an ethene-1,2-diyl group and $X^+$ is a cation, with the proviso that the dye contains from 2 to 4 sulfonate, carboxylate and/or phosphonate groups but altogether not more than two sulfonate groups.

Additional objects, features and advantages of the invention will be set forth in the description which follows, and in part will be obvious from the description, or may be learned by practice of the invention. The objects, features and advantages of the invention may be realized and obtained by means of the instrumentalities and combinations particularly pointed out in the appended claims.

DETAILED DESCRIPTION OF THE PREFERRED EMBODIMENTS

A preferred recording material of the present invention contains neither diazonium compounds nor heat-curable or acid-curable amino compounds, nor any silver halide compounds and, apart from imagewise exposure and development, requires no additional operation, such as postbake or postexposure. The recording material should be virtually insensitive to daylight.

$Z^1$ and $Z^2$ are preferably isopropylidene groups, i.e., groups of the formula —$C(CH_3)_2$—.

Preferred cations include alkali metal and alkaline earth metal cations, especially sodium and potassium ions, as well as ammonium ions, or mono-, di-, tri- or tetraalkylammonium ions.

Dyes having symmetrical structure, i.e., those in which the (partly) aromatic radicals in the formula (I) are substituted in the same manner, are preferred. They are also generally easier to synthesize. Thus, dyes which contain two sulfonate groups are particularly advantageous. The dyes of the formula (I) surprisingly have absolutely no solubility-inhibiting effect on the mixture or a layer produced therefrom.

The $(C_1–C_4)$alkoxy group is preferably a methoxy or ethoxy group, while the $(C_7–C_{16})$aralkyl group is preferably a benzyl group. The halogen atoms are generally chlorine, bromine or iodine atoms, although any halogen can be used. In a first preferred embodiment, $R^9$ and $R^{10}$ are each a group of the formula —$[CH_2]_n$—$SO_3$—, in which n is an integer from 1 to 6. In a further preferred embodiment, one of the groups $R^1$ to $R^4$ or $R^5$ to $R^8$ is in each case a sulfonate group. As already mentioned, other substituents from among the stated ones, in particular carboxylate or phosphonate groups, may be present in addition to or in place of the sulfonate groups. If amino, $(C_1–C_4)$alkylamino or di$(C_1–C_4)$ alkylamino groups are present in the cyanine dye of the formula I, the number thereof is at least 2 less than that of the carboxylate, sulfonate and/or phosphonate groups, so that the dye remains anionic.

In the mixture according to the invention, the IR-absorbing, anionic cyanine dyes F1 to F4 mentioned below are particularly suitable (the cationic cyanine dye F5 serves for comparison purposes and is therefore marked with *).

F1

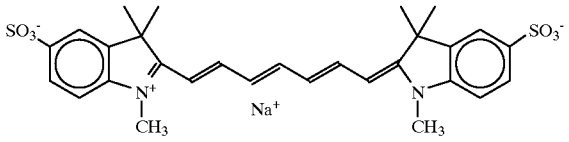

F2

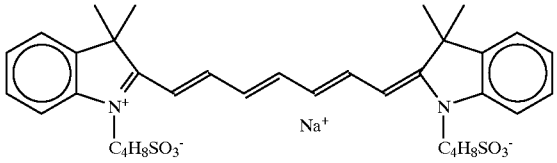

-continued

F3

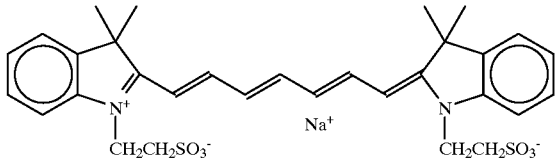

F4

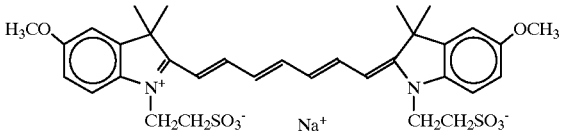

F5*

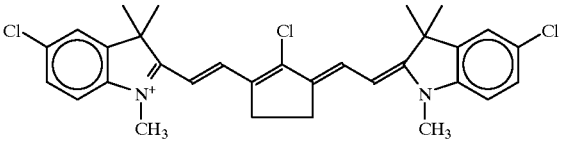

p-toluenesulfonate

Surprisingly, it has been found that the anionic IR-absorbing cyanine dyes have no solubility-inhibiting effect on the layer, but on the contrary increase the dissolution or swelling rate in an aqueous alkaline developer.

The amount of the IR-absorbing dye in general advantageously ranges from 0.2 to 30% by weight, preferably from 0.5 to 20% by weight, particularly preferably from 0.6 to 10% by weight, based in each case on the total weight of the dyes of the mixture. By combining suitable IR-absorbing dyes, it is possible to utilize not only narrow IR ranges but the entire wavelength range of the near IR spectrum. At least two IR-absorbing dyes may be required in some applications for covering the IR range from 700 to 1200 nm, in particular from 800 to 1100 nm, and/or for covering the near IR range.

The organic, polymeric binder is preferably a binder having acidic groups whose $pK_a$ is less than 13. A preferred binder is a novolak having a $pK_a$ of 9 to 11. This ensures that the layer is soluble or at least swellable in aqueous alkaline developers. In general, the binder can be a polymer or polycondensate, for example, a polyester, polyamide, polyurethane or polyurea. Polycondensates and polymers having free phenolic hydroxyl groups, as obtained, for example, by reacting phenol, resorcinol, a cresol, a xylenol or a trimethylphenol with aldehydes —especially formaldehyde—or ketones, are also particularly suitable. Condensates of sulfamoyl—or carbamoyl—substituted aromatics and aldehydes or ketones are also suitable. Polymers of bismethylol-substituted ureas, vinyl ethers, vinyl alcohols, vinyl acetals or vinylamides and polymers of phenyl acrylates and copolymers of hydroxyphenylmaleimides are likewise suitable. Furthermore, polymers having units of vinylaromatics, N-aryl(meth)acrylamides or aryl(meth)acrylates may be mentioned, it being possible for each of these units also to have one or more carboxyl groups, phenolic hydroxyl groups, sulfamoyl groups or carbamoyl groups. Specific examples include polymers having units of (2-hydroxyphenyl)-(meth)acrylate, of N-(4-hydroxyphenyl)-(meth)acrylamide, of N-(4-sulfamoylphenyl)-(meth)acrylamide, of N-(4-hydroxy-3,5-dimethylbenzyl)-(meth)acrylamide, of 4-hydroxystyrene or of hydroxyphenylmaleimide. The polymers may additionally contain units of other monomers which have no acidic units. Such units include vinylaromatics, methyl (meth) acrylate, phenyl (meth)acrylate, benzyl (meth)acrylate, methacrylamide or acrylonitrile. In this context, the term "(meth)acrylate" represents acrylate and/or methacrylate. The same applies to "(meth)acrylamide".

The amount of the binder in general advantageously ranges from 40 to 99.8% by weight, preferably from 70 to 99.4% by weight, particularly preferably from 80 to 99% by weight, based in each case on the total weight of the nonvolatile components of the mixture.

In a preferred embodiment, the polycondensate is a novolak, preferably a cresol/formaldehyde or a cresol/xylenol/formaldehyde novolak, the amount of novolak advantageously is at least 50% by weight, preferably at least 80% by weight, based in each case on the total weight of all binders.

Finally, the properties of the mixture according to the invention can also be influenced or controlled, for example, by using finely divided, non-inhibiting, soluble or dispersible dyes which have virtually no absorption in the IR range. In particular, triarylmethane, azine, oxazine, thiazine and xanthene dyes are suitable for this purpose. The amount of any dyes additionally present in the mixture is in general advantageously ranges from 0.01 to 30% by weight, preferably from 0.05 to 10% by weight, based in each case on the total weight of the nonvolatile components of the mixture.

In addition to the above components, the mixture may contain further additives which do not inhibit the layer, e.g., carbon black pigments as additional IR absorbers, surfactants (preferably fluorine-containing surfactants or silicone surfactants), polyalkylene oxides for controlling the acidity of the acidic units and low molecular weight compounds having acidic units for increasing the development rate. However, the mixture desirably contains no components which might influence the sensitivity to daylight under the action of radiation in the ultraviolet or visible range of the spectrum.

Binder and IR-absorbing, anionic cyanine dyes are present in general as a mixture but may also form separate layers. By employing a separate arrangement of the binder and the IR-absorbing, anionic dyes, higher photosensitivity and better stability to aqueous alkaline developer solutions can often be achieved. In this embodiment, the dye layer is generally present above the binder layer. Owing to the hardness of the dye layer, the sensitivity of the surface of the recording material is simultaneously reduced. In this embodiment, the dye layer preferably comprises only one of the anionic cyanine dyes, however, more than one dye can be used if desired for any reason. The IR-sensitive dyes which are present only if required, generally are present in the binder layer underneath.

The present invention furthermore relates to a recording material having a substrate and a positive-working, IR-sensitive layer, wherein the layer comprises the mixture described. However, the mixture according to the invention can also be used for other purposes, for example, as a photoresist. The invention furthermore relates to a recording material having a substrate, a layer which predominantly or completely comprises at least one of said binders and a layer which essentially comprises at least one of the IR-absorbing, anionic dyes described or a mixture of these dyes with triarylmethane, azine, oxazine, thiazine and/or xanthene dyes (in the stated sequence). The dye layer may also contain dulling particles, e.g., $SiO_2$ particles or pigments. Additives for improving the uniformity may likewise be present therein in minor amounts.

Any known method can be used for the preparation of the recording material. For example, a mixture according to the invention can be dissolved in a solvent mixture which does not react irreversibly with the components of the mixture. The solvent should preferably be tailored to the intended coating process, the layer thickness, the composition of the layer and the drying conditions. Suitable solvents in general include ketones, such as methyl ethyl ketone (butanone), chlorinated hydrocarbons, such as trichloroethylene or 1,1,1-trichloroethane, alcohols, such as methanol, ethanol or propanol, ethers, such as tetrahydrofuran, glycol monoethers, such as ethylene glycol monoalkyl ether or propylene glycol monoalkyl ether, and esters, such as butyl acetate or propylene glycol monoalkyl ether acetate. Mixtures which may also contain solvents such as acetonitrile, dioxane, dimethylacetamide, dimethylsulfoxide or water, for special purposes can also be used. For the production of a double layer (binder layer+dye layer), the same or different solvents may be used for the two coatings.

Any substrate can be used in the present invention. The substrate in the recording material according to the invention is preferably an aluminum foil or a laminate of an aluminum foil and a polyester film. The aluminum surface is preferably roughened, anodized and hydrophilized with a compound which contains at least one phosphonic acid or phosphonate unit as known in the art. Before the roughening takes place, degreasing and pickling with alkalis and preliminary mechanical and/or chemical roughening may be effected.

A solution of the mixture according to the invention is then applied to this substrate and dried. The thickness of the IR-sensitive layer in general advantageously ranges from 1.0 to 5.0 $\mu$m, preferably from 1.5 to 3.0 $\mu$m. In the case of the double layer, the thickness of the binder layer in general advantageously ranges from 1.0 to 5.0 $\mu$m, preferably from 1.5 to 3.0 $\mu$m, while the dye layer is preferably substantially thinner in comparison and generally may have a thickness of only from 0.01 to 0.3 $\mu$m, preferably from 0.015 to 0.10 $\mu$m.

To protect the surface of the recording material, in particular from mechanical action, an overcoat can also be applied. The overcoat generally comprises at least one water-soluble polymeric binder, such as polyvinyl alcohol, polyvinylpyrrolidone, partially hydrolyzed polyvinyl acetates, gelatine, carbohydrates or hydroxyethylcellulose, and can be prepared for example, from an aqueous solution or dispersion which, if required, may contain small amounts, i.e., less than 5% by weight, based on the total weight of the coating solvents for the overcoat. The thickness of the overcoat is advantageously up to 5.0 $\mu$m, preferably from 0.1 to 3.0 $\mu$m, particularly preferably from 0.15 to 1.0 $\mu$m.

Finally, the present invention also relates to a process for the production of a planographic printing plate, in which the recording material according to the invention is exposed imagewise to infrared radiation and then developed in a conventional aqueous alkaline developer, preferably at a temperature of from 20 to 40° C. During the development, any water-soluble overcoat present is also preferably removed.

Any customary developers can be used for developing positive plates. Silicate-based developers which have a ratio of $SiO_2$ to alkali metal oxide of at least 1 are preferred. This ensures that the alumina layer of the substrate is not damaged. Preferred alkali metal oxides include $Na_2O$ and $K_2O$ and mixtures thereof. In addition to alkali metal silicates, the developer may contain further components, such as buffer substances, complexing agents, antifoams, organic solvents in small amounts, corrosion inhibitors, dyes, surfactants and/or hydrotropic agents.

The development is preferably carried out at temperatures of from 20 to 40° C. in mechanical processing units as known in the art. For regeneration, alkali metal silicate solutions having alkali metal contents of from 0.6 to 2.0 mol/l can be used. These solutions may have the same silica/alkali metal oxide ratio as the developer (as a rule, however, the silica/alkali metal oxide ratio is typically lower in the regeneration solution) and may likewise contain further conventional additives. The required amounts of regenerated material are preferably tailored to the developing apparatuses used, daily plate throughputs, image fractions, etc., and in general advantageously range from 1 to 50 ml per square meter of recording material. The addition can be regulated, for example, by employing conductivity measurement, as described, for example in EP-A 0 556 690, which is incorporated herein by reference. The recording material according to the invention can, if necessary, then be aftertreated with suitable correcting agents or preservatives.

To increase the resistance of the finished printing plate and hence to increase the possible print runs, the layer can heated briefly to elevated temperatures, ("baking"). This also increases the resistance of the printing plate to washout compositions, correcting agents and UV-curable printing inks. Such a thermal aftertreatment is described, inter alia, in DE-A 14 47 963 and GB-A 1 154 749, which are incorporated herein by reference.

The following examples explain in detail the subject of the invention. In the examples, pbw is part(s) by weight. Percentages and amounts are to be understood in weight units, unless stated otherwise. Comparative compounds or comparative examples are marked with an asterisk (*).

First, the dissolution-inhibiting or dissolution-imparting properties of the IR dyes were determined, by measuring the rate of removal of the layer, before and after imagewise heating in an aqueous alkaline developer, as follows:

1. Preparation of the basic formulation;
2. Addition of the additives to be investigated to the basic formulation;
3. Application of the coating solutions prepared from this formulation to a suitable substrate so that, after drying, a layer thickness of 1.9+/−0.1 μm results;
4. Determination of the rate of removal by development in a cell over a period of from 30 sec to 6 min;
5. If the rate of removal was lower than in the case of simultaneously measured basic formulation, the additive had a dissolution-imparting property and corresponded to the recording material according to the invention;
6. If the additive had an inhibiting effect, a sample was post-baked at from 50 to 160° C. for from 5 to 20 s and the rate of removal was determined as described under section 4. Possible layer loss due to the post-bake was taken into account. Its inhibiting effect in comparison with the basic formulation persisted, this also corresponded to the recording material according to the invention.

EXAMPLE 1

A basic formulation comprising

1a* 4.87 pbw of meta-/para-cresol/formaldehyde novolak, 20.00 pbw of ethylene glycol monoalkyl ether/methyl ethyl ketone (6:4) and 2.00 pbw of distilled water was prepared and in each case one of the following dyes was added to said formulation:

1b* 0.04 pbw of cationic cyanine dye F 5* (KF 1001 from Allied Signal Specialty Chemicals), 1c 0.04 pbw of anionic cyanine dye F 1 (Acid Bluegreen 780 ®PINA from Allied Signal Specialty Chemicals), 1d 0.04 pbw of anionic cyanine dye F 2 (Acid Bluegreen 762 ®PINA from Allied Signal Specialty Chemicals), 1e 0.04 pbw of anionic cyanine dye F 3 (Acid Bluegreen 765 ®PINA from Allied Signal Specialty Chemicals), 1f* 0.04 pbw of ®Flexoblau 630, a cationic dye from BASF AG, 1 g 0.04 pbw of anionic cyanine dye F4 (Acid Bluegreen 784 ®PINA from Allied Signal Specialty Chemicals), The coating solutions thus prepared were applied to aluminum foils roughened in hydrochloric acid, anodized in sulfuric acid and hydrophilized with polyvinylphosphonic acid. After drying for 2 min at 100° C., the layer thickness was 1.9+/−0.1 μm.

Determination of the rates of removal without post-bake

The development was carried out in a cell at a temperature of 23° C. with a potassium silicate developer which contained $K_2SiO_3$ (normality 0.8 mol/l in water) and 0.2% by weight of O,O'-biscarboxymethyl polyethylene glycol 1000 and 0.4% by weight of pelargonic acid. The duration of development was from 30 to 360 seconds.

TABLE 1A

| Cell development time | Rates of removal without post-bake [g/m²] | | | | | | |
|---|---|---|---|---|---|---|---|
| [s] | 1a* | 1b* | 1c | 1d | 1e | 1f* | 1g |
| 30 | 0.02 | 0.01 | 0.11 | 0.09 | 0.10 | 0.05 | 0.05 |
| 60 | 0.11 | 0.05 | 0.29 | 0.23 | 0.23 | 0.07 | 0.18 |
| 120 | 0.34 | 0.23 | 0.68 | 0.48 | 0.51 | 0.18 | 0.45 |
| 240 | 0.59 | 0.43 | 1.12 | 0.81 | 0.91 | 0.60 | 0.86 |
| 360 | 0.96 | 0.61 | 1.81 | 1.43 | 1.85 | 0.81 | 1.51 |

The table shows that, in Examples 1b* and 1f*, the removal of the layer is reduced compared with Example 1a*, i.e., the cationic cyanine dye F5* as well as the Flexoblau 630 have a solubility-inhibiting effect on the layer. On the other hand, the anionic cyanine dyes in Examples 1c, 1d, 1e and 1g according to the invention result in increased removal of the layer by the aqueous alkaline developer.

Determination of the rates of removal with post-bake

TABLE 1B

| Cell development time | Rate of removal after post-bake for 20 s at 50° C. | |
|---|---|---|
| [s] | 1b* | 1f* |
| 30 | 0.05 | 0.02 |
| 60 | 0.15 | 0.03 |
| 120 | 0.44 | 0.18 |
| 240 | 0.85 | 0.52 |
| 360 | 1.21 | 0.75 |

The relatively gentle post-bake accordingly resulted in virtually no change in the rates of removal compared with the recording materials not post-baked.

TABLE 1C

| Cell development | Rate of removal after 5 s at 160° C. | | Rate of removal after 20 s at 160° C. | |
|---|---|---|---|---|
| time [s] | 1b* | 1f* | 1b* | 1f* |
| 30 | 0.10 | 0.01 | 0.10 | 0.01 |
| 60 | 0.20 | 0.05 | 0.19 | 0.04 |

TABLE 1C-continued

| Cell development | Rate of removal after 5 s at 160° C. | | Rate of removal after 20 s at 160° C. | |
|---|---|---|---|---|
| time [s] | 1b* | 1f* | 1b* | 1f* |
| 120 | 0.28 | 0.19 | 0.36 | 0.22 |
| 240 | 0.65 | 0.60 | 0.98 | 0.59 |
| 360 | 1.09 | 0.73 | 1.46 | 0.70 |

Table 1c shows that only Comparative Example 1b*, which contains a cationic IR-absorbing dye, experiences an increase in solubility in an aqueous alkaline developer after a post-bake. In Example 1f*, on the other hand, the solubility-inhibiting effect is retained.

EXAMPLE 2

Coating solutions were prepared from 0.87 pbw of meta-/para-cresol/formaldehyde novolak, 0.10 pbw of polyhydroxystyrene ($M_W$ 4000), 4.50 pbw of tetrahydrofuran, 1.80 pbw of ethylene glycol monomethyl ether, 2.70 pbw of methanol and 0.03 pbw of the respective IR absorber (cf. Table 2).

TABLE 2

| Number | IR absorber |
|---|---|
| 2a* | without absorber |
| 2b* | Carbon black pigment type HCC from Grolman |
| 2c | F1 |
| 2d | F2 |
| 2e | F3 |

The coating solutions were applied to aluminum foils roughened in hydro-chloric acid, anodized in sulfuric acid and hydrophilized with polyvinyl-phosphonic acid. After drying for 2 min at 100° C., the layer thickness was 2 μm.

These recording materials were then exposed to infrared radiation in an outer drum exposure unit. An Nd-YAG laser having a wavelength of 1064 nm and a power of 7.0 W, a write speed of 120 revolutions of the drum per min and a beam width of 10 μm was used for this purpose.

Development was carried out in a conventional automatic developing unit at a throughput speed of 0.8 m/min and a temperature of 23° C. using a potassium silicate developer which contained $K_2SiO_3$ (normality 0.8 mol/l in water) and 0.2% by weight of O,O'-biscarboxymethyl polyethylene glycol 1000 and 0.4% by weight of pelargonic acid.

Table 3 shows the image reproduction of dots of a test wedge.

TABLE 3

| Number | Reproduction of percent dot area)+ | Reproduction of the dot wells |
|---|---|---|
| 2a* | no development | no development |
| 2b* | 4 | 97 |
| 2c | 3 | 98 |
| 2d | 3 | 99 |
| 2e | 2 | 98 |

The table shows that recording materials without IR absorber cannot be developed. In the case of the recording material containing carbon black pigment (Experiment 2b*), the reproduction of the percent dot area was substantially poorer, and the reproduction of the dot wells was also poorer.

EXAMPLE 3

A coating solution was prepared from 0.60 pbw of meta-/para-cresol/formaldehyde novolak, 0.10 pbw of F2, 6.00 pbw of tetrahydrofuran and 4.00 pbw of ethylene glycol monoalkyl ether.

The solution was either used as such (Example 3a) or 0.20 pbw of an esterification product of 1 mol of 2,3,4-trihydroxybenzophenone and 1.5 mol of 1,2-naphthoquinone-2-diazide-5-sulfonyl chloride was added (Example 3b*).

The coating solutions with and without diazo compound were applied to aluminum foils roughened in hydrochloric acid, anodized in sulfuric acid and hydrophilized with polyvinylphosphonic acid. After drying for 2 min at 100° C., the layer thickness was 2 μm.

The recording materials were then exposed to infrared radiation in an outer drum exposure unit. An Nd-YAG laser having a wavelength of 1064 nm and a power of 7.0 W, a write speed of 120 rpm and a beam width of 10 μm was used for this purpose (before the IR exposure, the plates were exposed to daylight for 0 minutes, 1 hour, 1 day or 1 week).

The development was carried out in a conventional automatic developing unit at a throughput speed of 0.8 m/min and a temperature of 23° C. using a potassium silicate developer which contained $K_2SiO_3$ (normality 0.8 mol/l in water) and 0.2% by weight of O,O'-biscarboxymethyl polyethylene glycol 1000 and 0.4% by weight of pelargonic acid.

TABLE 4

| | Development behavior after exposure to daylight | | |
|---|---|---|---|
| Number | 0 min exposure | 1 h exposure | 1 week's exposure |
| 3a | standard | standard | standard |
| 3b* | standard | total removal of layer | — |

The table shows that the diazo-containing layer was completely removed during development when the recording material had been exposed to daylight beforehand for 1 hour (or less). On the other hand, the recording material according to the invention was insensitive to daylight and could also be processed without problems when it had been exposed to daylight for 1 week (or more).

EXAMPLE 4

This example shows the advantage of IR dyes with and without indicator dyes in comparison with carbon black-sensitized recording materials with regard to mechanical surface attack.

Coating solutions were prepared from 0.72 pbw of meta-/para-cresol/formaldehyde novolak, 0.10 pbw of copolymer of (2-hydroxyphenyl) methacrylate and methyl methacrylate ($M_W$ 4000), 0.05 pbw of 2,4-dihydroxybenzophenone, 0.02 pbw of Flexoblau 630 from BASF (only in the layers 4b and 4d), 0.08 pbw of F 3 (only in the layers 4a and 4b), 0.04 pbw of carbon black pigment type HCC from Grolman (only in the layers 4c* and 4d*).

These solutions were applied to aluminum foils roughened in hydrochloric acid, anodized in sulfuric acid and hydrophilized with polyvinylphosphonic acid. After drying for 2 min at 100° C., the layer thickness was 2 μm.

The recording materials were then exposed to infrared radiation in an outer drum exposure unit. The Nd-YAG laser also used in the preceding examples and having a power of 7.0 W, a write speed of 120 rpm and a beam width of 10 $\mu$m was used for this purpose.

Before the development, the recording materials were pretreated in a hardness tester. A rubber wheel having a diameter of from about 1 to 2 cm and a width of the contact surface of about 1 mm was rolled over the material to be tested. With the aid of weights, the contact pressure was set to the values shown in the table.

The development was carried out in a conventional automatic developing unit at a throughput speed of 0.8 m/min and a temperature of 23° C. using a potassium silicate developer which contained $K_2SiO_3$ (normality 0.8 mol/l in water) and 0.2% by weight of O,O'-biscarboxymethyl polyethylene glycol 1000 and 0.4% by weight of pelargonic acid.

Table 5 shows the results after the treatment of the recording materials with the hardness tester. Depending on the mechanical sensitivity of the coating surface, impression marks (referred to as "marks" in the table) are found on the material.

TABLE 5

| | Force acting on the running wheel [N] | | | |
|---|---|---|---|---|
| Example | 0.5 | 1 | 2 | 5 |
| 4a | — | marks | marks | marks |
| 4b | — | — | — | marks |
| 4c* | marks | marks | marks | marks |
| 4d* | — | — | marks | marks |

Recording materials with additional indicator dye are less sensitive to mechanical effects. The table furthermore shows that IR-sensitized layers are less sensitive to impression than those pigmented with carbon black.

An aqueous solution of a polyvinyl alcohol (K value 4; residual acetyl group content 12%) according to EP-A 0 290 916 was then applied to the IR-sensitive layer of the recording material according to Example 4a and dried. After the drying, the thickness of the overcoat thus produced was 0.2 $\mu$m. In the testing of this material (Example 4e) in the manner described, no impression marks were detectable.

EXAMPLE 5

Example 5 shows the effect of IR absorber mixtures on recording materials.

A coating solution was prepared from 0.85 pbw of meta-/para-cresol/formaldehyde novolak,
0.06 pbw of styrene/acrylate copolymer ($M_W$ 6.500; acid number 205),
4.50 pbw of tetrahydrofuran,
1.80 pbw of ethylene glycol monomethyl ether and
2.70 pbw of methanol.
0.04 pbw of dye F 1 (Example 5a) or
0.04 pbw of dye F 1 and
0.04 pbw of carbon black pigment type HCC from Grolman (Example 5b) or
0.04 pbw of carbon black pigment type HCC from Grolman (Example 5c*)
were mixed with this solution.

The respective coating solutions were applied to aluminum foils which beforehand had been roughened in hydrochloric acid, anodized in sulfuric acid and hydrophilized with polyvinylphosphonic acid. After drying for 2 min at 100° C., the layer thickness was 2 $\mu$m.

The recording materials were then exposed to the following laser systems:

a) an outer drum exposure unit; a laser having a wavelength of 830 nm and a power of 5.0 W, a write speed of 120 rpm and a beam width of 10 $\mu$m was used,
b) an inner drum exposure unit; an Nd-YAG laser having a wavelength of 1064 nm, a power of 8.0 W, a write speed of 367 m/s and a beam width of 10 $\mu$m was used.

The development was carried out in a conventional automatic developing unit at a throughput speed of 1.0 m/min and a temperature of 23° C. using a potassium silicate developer which contained $K_2SiO_3$ (normality 0.8 mol/l in water) and 0.2% by weight of O,O'-biscarboxymethyl polyethylene glycol 1000 and 0.4% by weight of pelargonic acid.

TABLE 7

| Example | Development behavior after exposure to laser at 830 nm | Development behavior after exposure to laser at 1064 nm |
|---|---|---|
| 5a | background just free | cannot be developed |
| 5b | background free | background free |
| 5c* | background free | background free |

The table shows that sensitization in the entire range from 830 nm to 1064 nm is possible by suitable mixing of IR absorbers.

EXAMPLE 6:

A coating solution was prepared from 4.87 pbw of meta-/para-cresol/formaldehyde novolak,
20.00 pbw of ethylene glycol monomethyl ether and
2.00 pbw of butanone.

The solution was applied to the substrate described in Example 5 and dried (2 min; 100° C.). The layer thickness was then 2 $\mu$m.

Solutions of the anionic cyanine dyes F1 (Example 6a), F2 (Example 6b) and F3 (Example 6c) in water/isopropanol (1:1) were then applied to the binder layer thus produced and were dried so that the layer thickness in each case was 0.02 $\mu$m.

As described in the preceding example, the mechanical sensitivity of the surface of the recording material was then investigated. In none of the Examples 6a to 6c were traces of the running wheel detectable.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

The priority document DE 198 34 745.6 filed Aug. 1, 1998 is incorporated herein by reference in its entirety.

What is claimed is:

1. A positive-working, radiation-sensitive mixture comprising:

an organic, polymeric binder which is insoluble in water but soluble or at least swellable in aqueous alkaline solution, and at least one IR-absorbing anionic cyanine dye, of the formula (I)

(I)

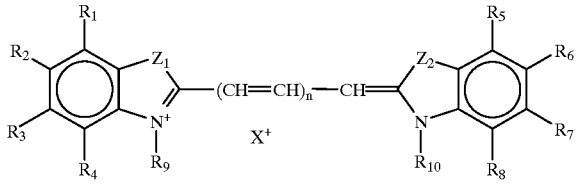

wherein n is 2 or 3, $R^1$ to $R^8$ independently of one another, are a hydrogen or halogen atom, a sulfonate, carboxylate, phosphonate, hydroxyl, $(C_1–C_4)$ alkoxy, nitro, amino, $(C_1–C_4)$ alkylamino or di$(C_1–C_4)$ alkylamino group or a $(C_6–C_{10})$ aryl group which in turn may be substituted by one or more halogen atoms and/or one or more sulfonate, carboxylate, phosphonate, hydroxyl, $(C_1–C_4)$ alkoxy, nitro, amino, $(C_1–C_4)$ alkylamino and/or di$(C_1–C_4)$ alkylamino groups, $R^9$ and $R^{10}$ independently of one another, are a straight-chain or branched $(C_1–C_6)$ alkyl, a $(C_7–C_{16})$ aralkyl or a $(C_6–C_{10})$ aryl group, each of which in turn may be substituted by one or more halogen atoms and/or one or more sulfonate, carboxylate, phosphonate, hydroxyl, $(C_1–C_4)$ alkoxy, nitro, amino, $(C_1–C_4)$ alkylamino and/or di$(C_1–C_4)$ alkylamino groups, $Z^1$ and $Z^2$ independently of one another, are a sulfur atom, a di$(C_1–C_4)$ alkylmethylene group or an ethene-1,2-diyl group and $X^+$ is a cation, with the proviso that the dye contains from 2 to 4 sulfonate, carboxylate and/or phosphonate groups but altogether not more than two sulfonate groups.

2. A radiation-sensitive mixture as claimed in claim 1, wherein the cation $X^+$ is an alkali metal or alkaline earth metal cation.

3. A radiation-sensitive mixture as claimed in claim 1, wherein the cation $X^+$ is a sodium or potassium ion, an ammonium ion or a mono-, di-, tri- or tetra-alkylammonium ion.

4. A radiation-sensitive mixture as claimed in claim 1, wherein the binder comprises acidic groups having a $pK_a$ value of less than 13.

5. A radiation-sensitive mixture as claimed in claim 4, wherein the binder is a polycondensate of phenols or sulfamoyl- or carbamoyl-substituted aromatics with aldehydes or ketones, a reaction product of diisocyanates with diols or diamines or a polymer having units of vinylaromatics, N-aryl(meth)acrylamides or aryl (meth) acrylates, these units each further more containing one or more carboxyl groups, phenolic hydroxyl groups, sulfamoyl groups or carbamoyl groups.

6. A radiation-sensitive mixture as claimed in claim 5, wherein the polycondensate is a novolak, the amount of novolak being at least 50% by weight, based on the total weight of all binders.

7. A radiation-sensitive mixture as claimed in claim 5, wherein the polycondensate is a cresol/formaldehyde or a cresol/xylenol/formaldehyde novolak.

8. A radiation-sensitive mixture as claimed in claim 1, wherein the amount of the binder is from 40 to 99.8% by weight, based on the total weight of nonvolatile components of the mixture.

9. A radiation-sensitive mixture as claimed in claim 1, wherein the IR-absorbing dye experiences no increase in solubility after a post-bake.

10. A radiation-sensitive mixture as claimed in claim 1, wherein the amount of the IR-absorbing anionic cyanine dye is from 0.2 to 30% by weight, based on the total weight of dyes of the non-volatile components of the mixture.

11. A radiation-sensitive mixture as claimed in claim 1, which contains two or more different anionic cyanine dyes of the formula I in order to cover the near IR wavelength range.

12. A radiation-sensitive mixture as claimed in claim 1, further comprising a carbon black pigment.

13. A recording material comprising a substrate and a radiation-sensitive layer, wherein the layer comprises a radiation-sensitive mixture as claimed in claim 1.

14. A recording material comprising a substrate, and a layer comprising an organic, polymeric binder which is insoluble in water but soluble or at least swellable in aqueous alkaline solution, and a dye layer comprising at least one dye of formula I (I)

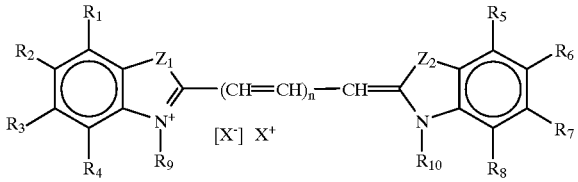

wherein n is 2 or 3, $R^1$ to $R^8$ independently of one another, are a hydrogen or halogen atom, a sulfonate, carboxylate, phosphonate, hydroxyl, $(C_1–C_4)$ alkoxy, nitro, amino, $(C_1–C_4)$ alkylamino or di$(C_1.C_4)$ alkylamino group or a $(C_6–C_{10})$ aryl group which in turn may be substituted by one or more halogen atoms and/or one or more sulfonate, carboxylate, phosphonate, hydroxyl, $(C_1–C_4)$ alkoxy, nitro, amino, $(C_1–C_4)$ alkylamino and/or di$(C_1–C_4)$ alkylamino groups, $R^9$ and $R^{10}$ independently of one another, are a straight-chain or branched $(C_1–C_6)$ alkyl, a $(C_7–C_{16})$ aralkyl or a $(C_6–C_{10})$ aryl group, each of which in turn may be substituted by one or more halogen atoms and/or one or more sulfonate, carboxylate, phosphonate, hydroxyl, $(C_1–C_4)$ alkoxy, nitro, amino, $(C_1–C_4)$ alkylamino and/or di$(C_1–C_4)$ alkylamino groups, $Z^1$ and $Z^2$ independently of one another, are a sulfur atom, a di$(C_1–C_4)$ alkylmethylene group or an ethene-1,2-diyl group and $X^+$ is a cation, with the proviso that the dye contains from 2 to 4 sulfonate, carboxylate and/or phosphonate groups but altogether not more than two sulfonate groups.

15. A recording material as claimed in claim 14, further comprising an overcoat comprising at least one water-soluble polymeric binder on the radiation-sensitive layer or on the dye layer, the overcoat having a thickness of up to 5.0 $\mu$m.

16. A recording material as claimed in claim 15, wherein the water-soluble polymeric binder comprises polyvinyl alcohol, polyvinylpyrrolidone, partially hydrolyzed polyvinyl acetate, gelatine, a carbohydrate or hydroxy ethylcellulose.

17. A recording material as claimed in claim 14, wherein the substrate comprises an aluminum foil.

18. A process for the preparation of a printing plate, comprising:

exposing a radiation-sensitive recording material as claimed in claim 14 imagewise to infrared radiation, and developing the exposed material with an aqueous alkaline solution.

* * * * *